United States Patent [19]

Meckl et al.

[11] Patent Number: 4,855,216

[45] Date of Patent: Aug. 8, 1989

[54] NO-RINSE PHOTOGRAPHIC PROCESSING METHOD AND THE STABILIZING BATH USED FOR THIS METHOD

[75] Inventors: Heinz Meckl, Bergisch-Gladbach; Erika Spriewald, Leverkusen; Günter Renner, Bergisch-Gladbach, all of Fed. Rep. of Germany

[73] Assignee: Agfa-Gevaert Aktiengesellschaft, Leverkusen, Fed. Rep. of Germany

[21] Appl. No.: 253,664

[22] Filed: Oct. 5, 1988

[30] Foreign Application Priority Data

Oct. 17, 1987 [DE] Fed. Rep. of Germany ..... 3735274
Jan. 13, 1988 [DE] Fed. Rep. of Germany ..... 3800681

[51] Int. Cl.[4] ..... G03C 5/39

[52] U.S. Cl. ..... 430/372; 430/380; 430/393

[58] Field of Search ..... 430/372, 380, 393; 544/362, 363; 71/90, 92

[56] References Cited

U.S. PATENT DOCUMENTS 4,618,569 10/1986 Kurematsu et al. ..... 430/372
4,778,748 10/1988 Kuse et al. ..... 430/372

*Primary Examiner*—Paul R. Michl
*Assistant Examiner*—Hoa Van Le
*Attorney, Agent, or Firm*—Connolly & Hutz

[57] ABSTRACT

A no-rinse processing method for the production of color photographic images comprising the steps of developing, bleaching, fixing and stabilizing, of which the bleaching and fixing steps may be combined into a bleach fixing step, gives dye images of satisfactory quality, even after prolonged use, if the stabilizing bath used in the stabilizing step contains an effective quantity of a pyrazole which, in one of the possible tautomeric forms, corresponds to the following general formula:

in which

X represents OH or $NH_2$, $R_1$ represents alkyl, substituted alkyl, aryl, substituted aryl or carboxyl, $R_2$ represents hydrogen, alkyl or substituted alkyl, $R_3$ represents hydrogen, alkyl, substituted alkyl, aryl or substituted aryl.

7 Claims, No Drawings

NO-RINSE PHOTOGRAPHIC PROCESSING METHOD AND THE STABILIZING BATH USED FOR THIS METHOD

This invention relates to a no-rinse photographic processing method and to the stabilizing bath used in this method, by which it is possible to produce dye images, of which the minimal densities are of excellent quality, even under the tropical storage conditions.

Color photographic processing methods for the production of dye images normally comprise the steps of developing bleaching, fixing, washing, stabilizing and drying, of which the bleaching and fixing steps may be combined into a single bleach-fixing step. Since a large amount of wastewater accumulates in the rinsing step, by which a number of chemicals are removed from the material to be processed, there has been no shortage of attempts to avoid this step and to carry out stabilization in such a way that an image of satisfactory quality is obtained although the chemicals present in the material from the preceding processing steps are no longer removed. Processes such as these are described, for example, in the following published European applications: 182 566, 185 371, 186 158, 186 169, 186 504 and 206 148. Although dye images of satisfactory quality, including those which do not yellow under tropical storage conditions, are produced with these known processes and, above all, with the stabilizing baths used therein, this only applies as long as the stabilizing bath is fresh. In the event of prolonged use of the stabilizing bath, the dye images produced show increasing yellowing under tropical storage conditions. Although it is possible to reduce yellowing by changing from the standard regeneration level of the stabilizing bath of 250 mg/m$^2$ for a three-stage cascade to higher regeneration levels, for example 500 to 1,000 ml/m$^2$, this results in the formation of an undesirably large quantity of used stabilizing bath, so that the actual advantage of the no-rinse processing method using a special stabilizing bath no longer exists.

Accordingly, the object of the present invention is to provide a stabilizing bath which, for standard regeneration levels, ensures that, even in the vent of prolonged use, the dye images produced have a quality under tropical storage conditions which would otherwise only be achieved in processes still comprising a rinsing step.

It has now been found that this object can be achieved by adding a special pyrazole compound to the stabilizing bath for a no-rinse processing method.

Accordingly, the present invention relates to a no-rinse processing method for the production of color photographic images comprising the steps of developing, bleaching, fixing and stabilizing, of which the bleaching and fixing steps may be combined into a bleach-fixing step, characterized in that the stabilizing bath used in the stabilizing step contains an effective quantity of a pyrazole which, in one of the possible tautomeric forms, corresponds to the following general formula:

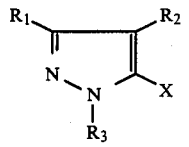

in which

X represents OH or $NH_2$, $R_1$ represents alkyl, substituted alkyl, aryl, substituted aryl or carboxyl, $R_2$ represents hydrogen, alkyl or substituted alkyl, $R_3$ represents hydrogen, alkyl, substituted alkyl, aryl or substituted aryl.

The alkyl and aryl radicals may be substituted in particular by carboxyl, sulfonyl and sulfonamide groups. The pyrazole compounds preferably contain at least one acidic group. The hydroxyl and amino groups in the 5-position may also be present as oxo or imino groups in another tautomeric form.

Compounds particularly suitable for use in accordance with the invention are shown in the following list:

| Compound | $R_1$ | $R_2$ | $R_3$ | X |
|---|---|---|---|---|
| 1 | $CH_3$ | H | 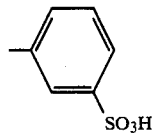 | $NH_2$ |
| 2 | $CH_3$ | H | 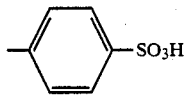 | $NH_2$ |
| 3 | $CH_3$ | H | 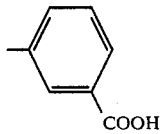 | $NH_2$ |

-continued
| Compound | $R_1$ | $R_2$ | $R_3$ | X |
|---|---|---|---|---|
| 4 | $C_2H_5$ | H | 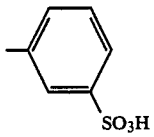 | $NH_2$ |
| 5 | t-$C_4H_9$ | H | 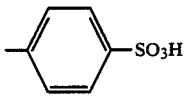 | $NH_2$ |
| 6 | $CH_3$ | $CH_3$ | 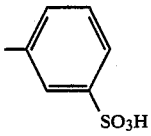 | $NH_2$ |
| 7 | $C_2H_5$ | $CH_3$ | 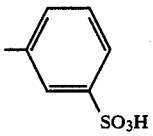 | $NH_2$ |
| 8 | $CH_3$ | H | 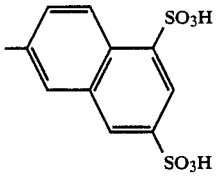 | $NH_2$ |
| 9 | COOH | H | $-CH_2-CH_2-COOH$ | $NH_2$ |
| 10 | $CH_3$ | $CH_3$ | 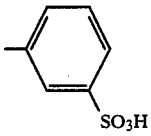 | OH |
| 11 | $CH_3$ | $C_2H_5$ | 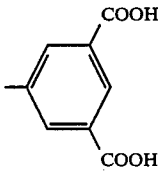 | OH |
| 12 | $CH_3$ | $CH_3$ | 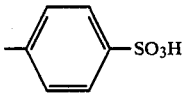 | OH |
| 13 | COOH | $CH_3$ | 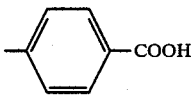 | OH |
| 14 | 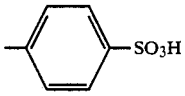 | $CH_3$ | 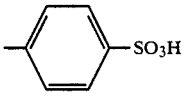 | OH |
| 15 | COOH | $CH_3$ | $-(CH_2)_3-COOH$ | OH |
| 16 | $CH_3$ | H | $CH_2-CH_2-COOH$ | OH |
| 17 | COOH | H | $CH_2-COOH$ | OH |
| 18 | COOH | H | $CH_2-CH_2-COOH$ | OH |

-continued

| Compound | $R_1$ | $R_2$ | $R_3$ | X |
|---|---|---|---|---|
| 19 | COOH | H | $(CH_2)_4$—COOH | OH |
| 20 | COOH | H | $(CH_2)_4$—$SO_3H$ | OH |
| 21 | $CH_3$ | H | H | $NH_2$ |
| 22 | $CH_3$ | $CH_3$ | H | $NH_2$ |
| 23 | COOH | H | H | $NH_2$ |
| 24 | t-$C_4H_9$ | H | H | $NH_2$ |

The present invention also relates to the stabilizing bath used in the method according to the invention which, in a preferred embodiment, contains at least one sequestering agent in addition to the pyrazole compound and has a pH value in the range from 3.0 to 7.8 and preferably in the range from 5.0 to 6.0. The desired pH value is established for example by neutralization of the acids being present in the stabilizing bath (sequestering agent, complexing agent) with NaOH, KOH, MgO or ammonia. In addition to the sodium, potassium, magnesium or ammonium ions, the stabilizing bath contains in particular sulfite ions which are preferably introduced as sodium, potassium or ammonium sulfite. The quantities comprise 0.1 to 10 g and preferably 1.5 to 2.5 g sulfite/l. The pyrazole compound is used in a quantity of, in particular, 0.1 to 10 g and preferably in a quantity of 0.5 to 3 g/l. The sequestering agent is used in a quantity of, in particular, 0.1 to 15 g and preferably in a quantity of 0.4 to 10 g/l, the sequestering agents used being preferably amino, polycarboxylic acids, particularly ethylene diamine tetracetic acid, and phosphonic acids of aliphatic alcohols, aliphatic amines or polyamines, more especially hydroxyethane diphosphonic acid. Both types of sequestering agents can be used alone or in combination with each other.

Finally, it is best to add a fungicide, more especially 5-chloro-3-methylisothiazolone, which is preferably used in a quantity of 0.01 to 0.05 g/l.

The halide contained in the light sensitive silver halide emulsions used in the recording material may be chloride, bromide, iodide or mixtures thereof. In a preferred embodiment, the halide content of at least one layer consists of 0 to 12 mol% of iodide, 0 to 50 mol% of chloride and 50 to 100 mol% of bromide. Emulsions with a very high chloride content (more than 80 mole-%) can be used as well. As a result, the halides are predominantly compact crystals which may have, for example, a cubical or octahedral form of transitional forms. The crystals may be characterised by the fact that they mainly have a thickness of more than 0.2μm. The average ratio of diameter of thickness is preferably less than 5:1, the diameter of a grain being defined as the diameter of a circle having an area equal to the projected area of the grain. In another preferred embodiment, all or some of the emulsions may contain mainly tabular silver halide crystals in which the ratio of diameter to thickness is greater than 5:1. The emulsions may be monodisperse or heterodisperse emulsions and preferably have an average grain size of from 0.2μm to 2.0μm.

The silver halide grains may also have a multilayered grain structure which in the simplest case is composed of an inner and an outer grain region (core/shell) which may differ from one another in their halide composition and/or other modifications such as doping. The grain size distribution may be either homodisperse or heterodisperse. The emulsion may contain other organic silver salts in addition to silver halide, e.g. silver benzotriazolate or silver behenate.

Two or more types of silver halide emulsions which are prepared separately may be used as mixtures.

The photographic emulsions may be prepared from soluble silver salts and soluble halides by various methods (e.g. P. Glafkides, Chimie et Physique Photographique, Paul Montel, Paris (1967), G.F. Duffin, Photographic Emulsion Chemistry, The Focal Press, London (1966), V.L. Zelikman et al, Making and Coating Photographic Emulsions, The Focal Press, London (1966)).

Precipitation of the silver halide is preferably carried out in the presence of the binder, e.g. gelatine, at an acid, neutral or alkaline pH, preferably with the addition of a silver halide complex former. The latter include compounds such as ammonia, thioethers, imidazole, ammonium thiocyanate and excess halide. The water soluble silver salts and the halides may be brought together either successively by the single jet process or simultaneously by the double jet process or by any combination of the two processes. The components are preferably dosed at increasing inflow rates but the "critical" rate of inflow which just fails to give rise to fresh nuclei should not be exceeded. The pAg during precipitation may vary within wide limits, the so called pAg controlled process being preferably employed, in which the pAg is kept at a particular, constant value or passes through a particular profile in the course of precipitation. Instead of the preferred method of precipitation with a halide excess, the so called inverse precipitation method with a silver ion excess may be employed. The silver halide crystals may be made to grow not only by precipitation but also by physical ripening (Ostwald ripening) in the presence of excess halide and/or silver halide complex forming agents. The growth of the emulsion grains may in fact take place predominantly as the result of Ostwald ripening, for which a fine grained, so called Lippmann emulsion is preferably mixed with a sparingly soluble emulsion and dissolved and reprecipitated on the latter.

Salts or complexes of metals such as Cd, Zn, Pb, Tl, Bi, Ir, Rh or Fe may be present during precipitation and/or physical ripening of the silver halide grains.

Precipitation may also be carried out in the presence of sensitizing dyes. Complex forming agents and/or dyes may be rendered inactive at any stage, for example by altering the pH or by oxidative treatment.

The binder used is preferably gelatine which may, however, be partly or completely replaced by other synthetic, semisynthetic or naturally occurring polymers. Examples of synthetic gelatine substitutes include polyvinyl alcohol, poly-N-vinyl pyrrolidone, polyacrylamides, polyacrylic acid and derivatives thereof, in particular their copolymers. Examples of naturally occurring gelatine substitutes include other proteins, such as albumin or casein, cellulose, sugar, starch and alginates. Semisynthetic gelatine substitutes are generally modified natural products. Cellulose derivatives such as hydroxyalkyl cellulose, carboxymethyl cellulose and phthalyl cellulose as well as gelatine derivatives obtained by reaction with alkylating or acylating agents or by grafting polymerisable monomers are examples of these semisynthetic substitutes.

The binders should contain a sufficient quantity of functional groups to give rise to sufficiently resistant layers in their reaction with suitable hardeners. Such functional groups are in particular amino groups but also carboxyl groups, hydroxyl groups and active methylene groups.

Gelatine, which is the preferred binder, may be obtained by acid or alkaline decomposition. The gelatine also may be oxidised. The preparation of such gelatines is described, for example, in "The Science and Technology of Gelatine", published by A.G. Ward and A. Courts, Academic Press 1977, page 295 et sec.. The gelatine should be as free as possible from photographically active impurities (inert gelatine). Gelatines with a high viscosity and low tendency to swell are particularly advantageous.

After crystal formation has been completed or even at an earlier stage, the soluble salts are removed from the emulsion, e.g. by shredding and washing, by flocculation and washing, by ultrafiltration or by means of ion exchangers.

The photographic emulsions may contain compounds to prevent fogging or to stabilize the photographic function during preparation, storage or photographic processing.

Particularly suitable compounds are azaindenes, especially tetra and pentaazaindenes, in particular those which are substituted with hydroxyl or amino groups. Compounds of this type are described e.g. by Birr, Z. Wiss. Phot. 47, (1952), pages 2 to 58. Salts of metals such as mercury or cadmium, aromatic sulphonic or sulphinic acid such as benzene sulphinic acid, and nitrogen- containing heterocyclic compounds such as nitrobenzimidazole, nitroindazole, (substituted) benzotriazole or benzothiazolium salts may be used as antifoggants. Heterocyclic compounds containing mercapto groups are particularly suitable, e.g. mercaptobenzothiazoles, mercaptogbenzimidazoles, mercaptotetrazoles, mercaptothiadiazoles and mercatopyrimidines. These mercapto azoles may also contain a group which confers solubility in water, e.g. a carboxyl group or a sulpho group. Other suitable compounds are published in Research Disclosure No. 17643 (1978), section VI.

The stabilizers may be added to the silver halide emulsions before, during or after ripening. The compounds may, of course, also be added to other photographic layers which are associated with a silver halide layer.

Mixtures of two or more of the above mentioned compounds may be used.

The photographic emulsion layers or other hydrophilic colloid layers of the light sensitive material prepared according to the invention may contain surface active agents for various purposes, such as coating auxiliaries and substances to prevent electric charging, to improve the antifriction properties, to emulsify the dispersion, to prevent sticking and to improve the photographic characteristics (e.g. development acceleration, high contrast, sensitization, etc.).

The photographic emulsions may be spectrally sensitized with methine dyes or other dyes. Cyanin dyes, merocyanine dyes and complex merocyanine dyes are particularly suitable.

Sensitizers may be dispensed with if the intrinsic sensitivity of the silver halide is sufficient for a particular spectral region, for example the blue sensitivity of silver bromide.

Colour photographic materials normally contain at least one red sensitive, one green sensitive and one blue sensitive emulsion layer. Non-diffusible monomeric or polymeric colour couplers are associated with these emulsion layers and may be present either in the same layer or in an adjacent layer. The red sensitive layers generally have cyan couplers associated with them, the green sensitive layers, magenta couplers, and the blue sensitive layers, yellow couplers.

Colour couplers for producing the cyan partial colour image are generally couplers of the phenol or α-naphthol series. Suitable examples are known in the literature.

Colour couplers for producing the yellow partial colour image are generally couplers containing an open chain ketomethylene group, in particular couplers of the type of α-acyl acetamides. Suitable examples of these couplers are α-benzoyl acetanilide couplers and α-pivaloyl acetanilide couplers, which are also known in the literature.

Colour couplers for producing the magenta partial colour image are generally couplers of the type of 5-pyrazolone, indazolone or pyrazoloazole. Numerous suitable examples of these compounds have been described in the literature.

The colour couplers may be 4-equivalent couplers or 2-equivalent couplers. The latter are derived from 4-equivalent couplers in that they contain a substituent in the coupling position, which substituent is split off in the coupling reaction. 2-equivalent couplers include both colourless couplers and couplers which have intense colour of their own which disappears in the process of colour coupling to be replaced by the colour of the image dye produced (masking couplers), as well as white couplers which mainly give rise to colourless products when they react with colour developer oxidation products. The 2-equivalent couplers also include couplers which contain a releasable group in the coupling position, this group being released in the reaction with colour developer oxidation products to unfold a particular desired photographic activity, e.g. as development inhibitor or accelerator, either directly or after one or more additional groups have been split off from this releasable group (e.g. DE-A-27 03 145, DE-A-28 55 697, DE-A-31 05-026 and DE-A-33 19 428). The known DIR couplers as well as DAR and FAR couplers are examples of such 2-equivalent couplers.

Since the DIR, DAR and FAR couplers are required mainly for the activity of the group which is released in the coupling reaction and the colour forming properties of these couplers are less important, DIR, DAR and FAR couplers of the type which mainly give rise to colourless products in the coupling reaction are also suitable (DE-A-1 547 650).

The group which is released may also be a ballast group so that the reaction with colour developer oxidation products gives rise to coupling products which are diffusible or at least have a certain, if limited mobility (U.S. Pat. No. 4,420,556).

High molecular weight colour couplers are described, for example, in DE-C-1 297 417, DE-A-24 07 569, DE-A-31 48 125, DE-A-32 17 200, DE-A-33 20 079, DE-A-33 24 932, DE-A-33 21 743, DE-A-33 40 376, EP-A-27 284 and U.S. Pat. No. 4,080,211. The high molecular weight colour couplers are generally prepared by the polymerization of ethylenically unsaturated monomeric colour couplers but they may also be obtained by polyaddition or polycondensation.

Incorporation of the couplers or other compounds in silver halide emulsion layers may be carried out by first preparing a solution, dispersion or emulsion of the compound and then adding this to the casting solution for the layer in which it is required. The choice of suitable solvents and dispersing agents depends on the particular solubility of the compound.

Methods of introducing compounds which are substantially insoluble in water by grinding them are described, for example, in DE-A-2 609 741 and DE-A-2 609 742.

Hydrophobic compounds may also be introduced into the casting solution by means of high boiling solvents, so called oil formers. Methods are described, for example, in U.S. Pat. No. 2,322,027, U.S. Pat. No. 2,801,170, U.S. Pat. No. 2,801,171 and EP-A-O 043 037.

So called polymeric oil formers, which may be oligomers or polymers, may be used instead of the high boiling solvents.

The compounds may also be introduced into the casting solution in the form of charged latices; see, for example, DE-A-2 541 230, DE-A-2 541 274, DE-A-2 835 856, EP-A-O 014 921, EP-A-O 069 671, EP-A-O 130 115 and U.S. Pat. No. 4,291,113.

Incorporation of anionic, water soluble compounds (e.g. dyes) in a diffusion fast form may also be achieved by means of cationic polymers, so called mordant polymers.

Examples of suitable oil formers include phthalic acid alkyl esters, phosphoric acid esters, citric acid esters, benzoic acid esters, alkylamides, fatty acid esters and trimesic acid esters.

The colour photographic material typically contains at least one red sensitive emulsion layer, at least one green sensitive emulsion layer and at least one blue sensitive emulsion layer on a support. The order in which these layers are arranged may be varied as desired. Couplers giving rise to cyan, magenta and yellow dyes are generally incorporated in the red, green and blue sensitive emulsion layers respectively but different combinations may also be used.

Each of the light sensitive layers may consist of a single layer or it may be composed of two or more silver halide emulsion partial layers (DE-C-1 121 470). Red sensitive silver halide emulsion layers are frequently arranged closer to the layer support than green sensitive silver halide emulsion layers which in turn are arranged closer to the layer support than blue sensitive layers and a light insensitive yellow filter layer is generally placed between the green sensitive layers and blue sensitive layers.

If the green sensitive or red sensitive layer has a sufficiently low intrinsic sensitivity, the yellow filter layer may be dispensed with and other layer arrangements may be used in which, for example, the blue sensitive layers are placed on the layer support, followed by the red sensitive layers which in turn are followed by the green sensitive layers.

The light insensitive interlayers generally placed between layers which differ in their spectral sensitivity may contain substances for preventing accidental diffusion of developer oxidation products from one light sensitive layer to another light sensitive layer of a different spectral sensitization.

When several partial layers of the same spectral sensitization are present in a material, these may differ from one another in their composition, in particular in the nature and quantity of the silver halide grains. The partial layer with the higher sensitivity is generally arranged further away from the support than the less sensitive partial layer. Partial layers of the same spectral sensitization may be adjacent to one another or separated by other layers, e.g. by layers of a different spectral sensitization. Thus, for example, all highly sensitive layers may be combined to form a layer packet and all low sensitivity layers may be combined to form another layer packet (DE-A 1 958 709, DE-A 2 530 645, DE-A 2 622 922).

The photographic material may also contain UV light absorbing compounds, white toners, solid particles, filter dyes, formalin acceptors and other substances.

UV light absorbent compounds serve to protect the image dyes against bleaching by daylight rich in UV light and as filter dyes they also serve to absorb the UV light present in the daylight used for exposure, thereby improving the colour reproduction of the film. Compounds of different structures are usually used for these two purposes. Examples of UV light absorbent compounds include aryl-substituted benzotriazole compounds (U.S. Pat. No. 3,533,794), 4-thiazolidone compounds (U.S. Pat. No. 3,314,794 and 3,352,681), benzophenone compounds (JP-A 2784/71), cinnamic acid ester compounds (U.S. Pat. No. 3,705,805 and 3,707,375), butadiene compounds (U.S. Pat. No. 4,045,229) and benzoxazole compounds (U.S. Pat. No. 3,700,455).

Ultraviolet absorbent couplers (such as cyan couplers of the α-naphthol series) and ultraviolet absorbent polymers may also be used. These ultraviolet absorbents may be fixed in a particular layer by mordanting.

Filter dyes suitable for visible light include oxonole dyes, hemioxonole dyes, styrene dyes, merocyanine dyes, cyanine dyes and azo dyes. Among these dyes, oxonole dyes, hemioxonole dyes and merocyanine dyes are particularly advantageous.

Suitable white toners are described, for example, in Research Disclosure, December 1978, page 22 et sec, number 17 643, chapter V.

Certain layers of binder, in particular the layer furthest removed from the support but occasionally also an interlayer, especially if it is the layer furthest removed from the support during the process of preparation, may contain photographically inert particles of an inorganic or organic nature, e.g. as matting agents or as spacers (DE-A 3 331 542, DE-A 3 424 893, Research Disclosure December 1978, page 22 et sec, Report No. 17 643, chapter XVI).

The average particle diameter of the solid particles may be in the range of from 0.1 to 10 μm. The particles are water insoluble and may be either soluble or insoluble in alkalis. If they are soluble in alkalis, they are generally removed from the photographic material in the alkaline development bath. Examples of suitable polymers include polymethyl methacrylate, copolymers of acrylic acid and methyl methacrylate and hydroxy propyl methyl cellulose hexahydrophthalate.

The binder of the material according to the invention, especially gelatine, is hardened with suitable hardeners, for example with hardeners of the type of epoxides, ethylene imine, acryloyl or vinyl sulphone. Hardeners of the diazine, triazine and 1,2-dihydroquinoline series are also suitable.

The binders of the material according to the invention are preferably hardened with instant hardeners.

Instant hardeners are compounds which cross-link suitable binders at such a rate that hardening has been completed to such an extent immediately after casting or at latest after 24 hours, preferably after not more than 8 hours, that no further change in sensitometry or swelling of the combination of layers will take place as the result of a crosslinking reaction. The swelling is taken to be the difference between the wet layer thickness and the dry layer thickness when a film is processed under aqueous conditions (Photogr. Sci. Eng. 8 (1964), 275; Photgr. Sci. Eng. (1972), 449).

These hardeners which react very rapidly with gelatine may be, for example, carbamoylpyridinium salts which are capable of reacting with free carboxyl groups present in the gelatine so that the carboxyl groups will react with free amino groups of the gelatine to form peptide bonds and effect crosslinking of the gelatine.

Suitable examples of instant hardeners include, for example, compounds corresponding to the following general formulae:

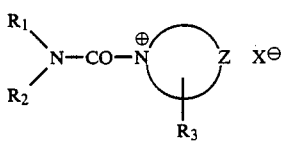

(a)

wherein $R_1$ denotes alkyl, aryl or aralkyl, $R_2$ has the same meaning as $R_1$ or denotes alkylene, arylene, aralkylene or alkaralkylene and the second bond is linked with a group of the formula

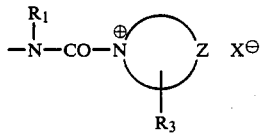

or $R_1$ and $R_2$ together represent the atoms required for completing an optionally substituted heterocyclic ring, for example a piperidine, piperazine or morpholine ring, which ring may be substituted, for example by $C_1$ or $C_3$ alkyl or halogen, $R_3$ stands for hydrogen, alkyl, aryl, alkoxy, $—NR_4—COR_5$, $—(CH_2)_m—NR_8R_9$, $—(CH_2)_n—CONR_{13}R_{14}$ or $—(CH_2)_p—$

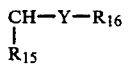

or a bridging member or a direct bond attached to a polymer chain, and $R_4$, $R_6$, $R_9$, $R_{14}$, $R_{15}$, $R_{17}$, $R_{18}$ and $R_{19}$ stand for hydrogen or $C_1$ to $C_4$ alkyl, $R_5$ denotes hydrogen, $C_1$ to $C_4$ alkyl or $NR_6R_7$, $R_8$ denotes $COR_{10}$, $R_{10}$ denotes $NR_{11}R_{12}$, $R_{11}$ denotes $C_1$ to $C_4$ alkyl or aryl, in particular phenyl, $R_{12}$ denotes hydrogen, $C_1$ to $C_4$ alkyl or aryl, in particular phenyl, $R_{13}$ denotes hydrogen, $C_1$ to $C_4$ alkyl or aryl, in particular phenyl, $R_{16}$ denotes hydrogen, $C_1$ to $C_4$ alkyl, $COR_{18}$ or $CONHR_{19}$, m stands for a number from 1 to 3, n stands for a number from 0 to 3, p stands for a number from 2 to 3 and Y stands for O or $NR_{17}$ or $R_{13}$ and $R_{14}$ together represent the atoms required for completing an optionally substituted heterocyclic ring, for example a piperidine, piperazine or morpholine ring, which ring may be substituted for example with $C_1$ to $C_3$ alkyl or halogen, Z denotes the carbon atoms required for completing a 5- or 6-membered aromatic heterocyclic ring optionally with a condensed benzene ring attached, and $X^{\ominus}$ denotes an anion, which is not present when an anionic group is already attached to the remainder of the molecule;

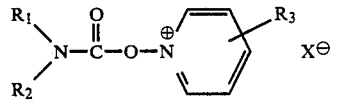

wherein $R_1$, $R_2$, $R_3$ and $X^-$ have the meanings given for formula (a).

EXAMPLE 1

Color paper, for example Agfacolor type 8, is exposed to form an image and processed as follows:

Developing: 3.5 minutes at 33° C., regeneration level 325 ml/m².

Bleach fixing: 1.5 minutes at 30° C., regeneration level 100 ml/m²

Stabilizing: 3-stage countercurrent cascade, 1 minute at 30° C. in each stage, regeneration level 250 ml/m², regeneration in the third stage.

Drying.

Composition of the baths

Developer, 1 liter

| | |
|---|---|
| Benzylalcohol | 13 ml |
| Hydroxyl ammonium sulfate | 3 g |
| Sodium sulfite | 2 g |
| 4-Amino-N—ethyl-N(β-methanesulfonamido-ethyl)-m-toluidine sesquisulfate monohydrate) | 4.5 g |
| Potassim carbonate | 36 g |
| Potassium bromide | 1.4 g |
| Diethylenetriamine pentaacetic acid, pentasodium salt | 2 g |
| Diethylene glycol | 12 ml |
| pH = | 10.4 |

Bleach-fixing bath, 1 liter

To assimilate the used state, it additionally contains silver and developer:

| | |
|---|---|
| Ammonium-iron salt of ethylenediamine tetraacetic acid | 45 g |
| Sodium sulfite | 5 g |

-continued

| | |
|---|---|
| Ethylenediamine tetraacetic acid | 5 g |
| Ammoniumthiosulfate | 100 g |
| 4-amino-N—ethyl-N(β-methanesulfonamido-ethyl)-m-toluidine sesquisulfate (monohydrate) | 2 g |
| Silver (13.5 g silver chloride dissolved in the bath | 10 g |
| pH = 8.0 (adjusted with potassium carbonate) | |

Stabilizing bath 1

1 liter water contains:
ammonium salt of hydroxyethane diphosphonic acid: 2 g
ammonium salt of ethylene diamine tetraacetic acid: 0.5 g
ammonium hydrogen sulfite: 1.7 g
5-chloro-3-methylisothiazolone: 0.03 g
pH: 7.5.

To assimilate the used state, the bath is prepared as follows:

1st stage: 800 ml stabilizing bath +200 ml used bleach-fixing bath
2nd stage: 960 ml stabilizing bath +40 ml used bleach-fixing bath
3rd stage: 992 ml stabilizing bath +8 ml used bleach-fixing bath.

The processed color paper is stored for 7 days at 60° C./ 90% relative air humidity.

The results are shown in the following Table.

EXAMPLE 2

The processing method and also the composition of the developer and bleach fixing baths correspond to Example 1.

Stabilizing bath 2

1 liter contains:
ammonium salt of hydroxyethane diphosphonic acid: 8 g
ammonium salt of ethylene diamine tetraacetic acid: 0.5 g
ammonium hydrogen sulfide: 1.7 g
ammonium chloride: 2 g
5-chloro-3-methylisothiazolone: 0.03 g
pH: 7.5

The used state of the stabilizing bath was simulated and the processed images stored in the same way as in Example 1.

EXAMPLE 3

The processing method and also the composition of the developer and bleach fixing baths correspond to Example 1.

Stabilizing bath 3

1 liter contains:
ammonium salt of hydroxyethane diphosphonic acid: 8 g
ammonium salt of ethylene diamine tetraacetic acid: 0.5 g
ammonium hydrogen sulfide: 1.7 g
ammonium chloride: 2 g
pyrazole compound 1: 1 g
5-chloro-3-methylisothiazolone: 0.03 g
pH: 7.5

The used state of the stabilizing bath was simulated and the processed images stored in the same way as in Example 1.

EXAMPLE 4

This Example corresponds to Example 3 except that the pyrazole compound 1 was replaced by the same quantity of pyrazole compound 12.

EXAMPLE 5

This Example corresponds to Example 1 except that the stabilizing bath used in the three-stage countercurrent cascade was replaced by rinsing for 3 minutes at 30° C. with 5 l/m$^2$.

The processed images were stored as in Example 1.

Examples 3 and 4 are Examples according to the invention which are compared with Examples 1 and 2, which do not correspond to the invention but which also relate to a no-rinse stabilizing bath, and with Example 5 in which the material was washed in the usual way. A material before storage at 60° C./90% relative humidity was also included in the comparison. The minimal densities of the three different image dyes were determined.

TABLE of minimal densities

| | Before storage | After storage for 7 days at (60° C./90% relative humidity | | | | |
|---|---|---|---|---|---|---|
| | | Ex. 1 | Ex. 2 | Ex. 3 | Ex. 4 | Ex. 5 |
| Yellow | 0.10 | 0.20 | 0.18 | 0.15 | 0.16 | 0.16 |
| Magenta | 0.10 | 0.13 | 0.12 | 0.12 | 0.12 | 0.12 |
| Cyan | 0.09 | 0.10 | 0.10 | 0.09 | 0.09 | 0.09 |

The Table shows that the processing method according to the invention, which is based essentially on the stabilizing bath according to the invention, is superior to known no-rinse stabilizing processes and gives the same or even better results than the conventional process comprising a rinsing step.

EXAMPLE 6

The processing method and also the composition of the developer and bleach fixing baths correspond to Example 1.

Stabilizing Bath 5

1 liter contains:
sodium salt of hydroxyethane diphosphonic acid: 6 g
sodium salt of ethylene diamine tetraacetic acid: 0.4 g
sodium sulfite: 2.2 g 5-chloro-3-methylisothiazolone: 0.03 g pH: 5.0 (adjusted with hydroxy ethane diphosphonic acid)

The used state of the stabilizing bath was simulated in the same way as in Example 1.

EXAMPLE 7

The processing method and also the composition of the developer and bleach fixing baths correspond to Example 1.

Stabilizing bath 3

1 liter contains: sodlium salt of hydroxyethane diphosphonic acid: 6 g sodium salt of ethylenediamine tetracetic acid: 0.4 g sodium sulfite: 2.2 g pyrazole compound 1: 1 g
5-chloro-3-methylisothiazolone: 0.03 g pH: 5.0 (adjusted with hydroxy ethane diphosphonic acid)

The used state of the stabilizing bath was simulated in the same way as in Example 1.

EXAMPLE 8

This Example corresponds to Example 1 except that the stabilizing bath used in the three-stage counter-current cascade was replaced by rinsing for 3 minutes at 30° C. with 5 l/m$^2$.

The processed images of examples 6, 7 and 8 were stored 7 days at 60° C. and 90% relative humidity and 14 days at 80° C. and 40% relative humidity.

Example 7 is an Example according to the invention which is compared with Example 6, which does not correspond to the invention but which also relates to a norinse stabilizing bath, and with Example 8 in which the material was washed in the usual way. A material before storage was also included in the comparison. The minimal densities of the three different image dyes were determined.

Tables of minimal densities

| | Before storage | After storage for 7 days at 60° C./90% relative humidity | | |
|---|---|---|---|---|
| | | Ex. 6 | Ex. 7 | Ex. 8 |
| Yellow | 0.09 | 0.23 | 0.20 | 0.19 |
| Magenta | 0.09 | 0.14 | 0.14 | 0.14 |
| Cyan | 0.09 | 0.09 | 0.09 | 0.09 |

| | Before storage | After storage for 14 days at 60° C./40% relative humidity | | |
|---|---|---|---|---|
| | | Ex. 6 | Ex. 7 | Ex. 8 |
| Yellow | 0.09 | 0.20 | 0.17 | 0.16 |
| Magenta | 0.09 | 0.12 | 0.12 | 0.11 |
| Cyan | 0.09 | 0.90 | 0.09 | 0.09 |

The Tables show that the processing method according to the invention, which is based essentially on the stabilizing bath according to the invention, is superior to known no-rinse stabilizing processes and gives approximately the same results than the conventional process comprising a rinsing step.

EXAMPLE 9

Color paper, for example Ektaprint EC 2001, is exposed to form an image and processed as follows:

Developing: 45 seconds at 35° C., regeneration level 325 ml/m$^2$;

Bleach fixing: 45 seconds at 30° C., regeneration level 100 ml/m$^2$;

Stabilizing: 4-stage countercurrent cascade, 22.5 seconds at 30° C. in each stage, regeneration level 250 ml/m$^2$, regeneration in the forth stage.

Drying.

Composition of the baths

Developer, 1 liter

| | |
|---|---|
| Triethanolamine | 9 ml |
| N,N—Diethylhydroxyl amine | 4.4 g |
| 4-Amino-N—ethyl-N(β-methanesulfonamido-ethyl)-m-toluidine sesquisulfate (monohydrate) | 5 g |
| Potassium carbonate | 20 g |
| Potassium carbonate | 20 g |
| Potassium chloride | 1.6 g |
| Ethylenediamine tetraacetic acid, tetrasodium salt | 2 g |

-continued

| | |
|---|---|
| 1,2-Dihydroxybenzene-3,4,6-trisulfonic acid, trisodium salt | 0.5 g |
| pH = | 10.05 |

Bleach-fixing bath, 1 liter

To assimilate the used state, it additionally contains silver and developer:

| | |
|---|---|
| Ammonium-iron salt of ethylenediamine tetraacetic aci | 57 g |
| Sodium sulfite | 16 g |
| Ethylenediamine tetraacetic acid | 5 g |
| Ammonium thiosulfate | 100 g |
| 4-amino-N—ethyl-N(β-methanesulfonamido-ethyl)-m-toluidine sesquisulfate (monohydrate) | 2 g |
| Silver (13.5 g silver chloride dissolved in the bath) | 10 g |
| pH = 5.5 (adjusted with acetic acid) | |

Stabilizing bath 7

1 liter water contains:

sodium salt of ethylene diamine tetraacetic acid: 0.4 g sodium sulfite: 2.2 g 5-chloro-3-methylisothiazolone: 0.03 g pH: 6.0.

To assimilate the used state, the bath is prepared as follows:

1st stage: 800 ml stabilizing bath +200 ml used bleach-fixing bath

2nd stage: 960 ml stabilizing bath +40 ml used bleach-fixing bath

3rd stage: 992 ml stabilizing bath +8 ml used bleach-fixing bath.

4th stage: 998.4 ml stabilizing bath +1.6 ml used bleach-fixing bath.

EXAMPLE 10

The processing method and also the composition of the developer and bleach fixing baths correspond to Example 9.

Stabilizing bath 8

1 liter contains:

sodium salt of ethylene diamine tetraacetic acid: 0.4 g sodium sulfite: 2.2 g pyrazole compound 1: 1 g 5-chloro-3-methylisothiazolone: 0.03 g pH: 6.0

The used state of the stabilizing bath was simulated and the processed images stored in the same way as in Example 9.

EXAMPLE 11

This Example corresponds to Example 9 except that the stabilizing bath used in the four-stage counter-current cascade was replaced by rinsing for 1.5 minutes at 30° C. with 5 l/m$^2$.

The processed images were stored as in Example 9.

Example 10 is an Example according to the invention which is compared with Example 9, which does not correspond to the invention but which also relates to a no-rinse stabilizing bath, and with example 11 in which the material was washed in the usual way. A material before storage was also included in the comparison. The minimal densities of the three different image dyes were determined.

| Tables of minimal densities | | | | |
|---|---|---|---|---|
| | Before storage | After storage for 7 days at 60° C./90% relative humidity | | |
| | | Ex. 9 | Ex. 10 | Ex. 11 |
| Yellow | 0.10 | 0.24 | 0.22 | 0.21 |
| Magenta | 0.11 | 0.15 | 0.15 | 0.15 |
| Cyan | 0.09 | 0.10 | 0.10 | 0.11 |
| | Before storage | After storage for 14 days at 80 and 40% relative humidity | | |
| | | Ex. 9 | Ex. 10 | Ex. 11 |
| Yellow | 0.10 | 0.24 | 0.23 | 0.22 |
| Magenta | 0.11 | 0.17 | 0.17 | 0.17 |
| Cyan | 0.9 | 0.10 | 0.10 | 0.11 |

The Tables show that the processing method according to the invention, which is based essentially on the stabilizing bath according to the invention, is superior to known no-rinse stabilizing processes and gives approximately the same results than the conventional process comprising a rinsing step.

We claim:

1. A no-rinse processing method for the production of color photographic images comprising the steps of developing, bleaching, fixing and stabilizing, of which the bleaching and fixing steps may be combined into a bleach-fixing step, characterized in that the stabilizing bath used in the stabilizing step contains an effective quantity of a pyrazole which, in one of the possible tautomeric forms, corresponds to the following general formula:

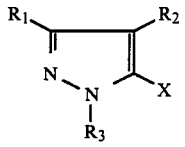

in which

X represents OH or $NH_2$, $R_1$ represents alkyl, substituted alkyl, aryl, substituted aryl or carboxyl, $R_2$ represents hydrogen, alkyl or substituted alkyl, $R_3$ represents hydrogen, alkyl, substituted alkyl, aryl or substituted aryl.

2. A method as claimed in claim 1, characterized in that the substituted alkyl and aryl radicals of the pyrazoles are substituted by carboxyl, sulfonyl and sulfonamide groups.

3. A method as claimed in claim 1, characterized in that the pyrazoles contain at least one acidic group.

4. A method as claimed in claim 1, characterized in that the pyrazoles are used in a quantity of 0.1 to 10 g/l stabilizing bath.

5. A method as claimed in claim 1, characterized in that the pH value of the stabilizing bath is 3.0 to 7.8.

6. A method as claimed in claim 1, characterized in that the stabilizing bath additionally contains at least one sequestering agent.

7. A method as claimed in claim 1, characterized in that the pH value of the stabilizing bath is 5.0 to 6.0.

* * * * *

UNITED STATES PATENT AND TRADEMARK OFFICE

CERTIFICATE OF CORRECTION

PATENT NO. : 4,855,216

DATED : August 8, 1989

INVENTOR(S) : HEINZ MECKL, ET AL.

It is certified that error appears in the above-identified patent and that said Letters Patent is hereby corrected as shown below:

Column 1, line 35, "$mg/m^2$" should read

-- $ml/m^2$ -- .

Column 2, line 3, "vent" should read

-- event -- .

Column 7, line 43, "mercaptogbenzimidazoles" should read

-- mercaptobenzimidazoles -- .

Column 8, line 67, "DE-A-33 21 743" should read

-- DE-A-33 31 743 -- .

Column 11, line 51, "$C_1$ or $C_3$" should read

-- $C_1$ to $C_3$ -- .

Column 12, line 24, please insert -- (b) -- near right-hand margin.

UNITED STATES PATENT AND TRADEMARK OFFICE

CERTIFICATE OF CORRECTION

PATENT NO. : 4,855,216

DATED : August 8, 1989

INVENTOR(S) : HEINZ MECKL, ET AL.

It is certified that error appears in the above-identified patent and that said Letters Patent is hereby corrected as shown below:

Column 12, line 54, "Potassim carbonate" should read -- Potassium carbonate -- .

Column 13, line 45, "sulfide" should read -- sulfite --.

Column 14, line 52, Please insert a comma between "2.2g" and "5-chloro-3".

Column 14, line 53, Please insert a comma between "0.03g" and "pH".

Column 14, line 63, "Stabilizing bath 3" should read -- Stabilizing bath 6 --.

Column 14, line 64, "sodlium" should read -- sodium --.

UNITED STATES PATENT AND TRADEMARK OFFICE

CERTIFICATE OF CORRECTION

PATENT NO. : 4,855,216

DATED : August 8, 1989

INVENTOR(S) : HEINZ MECKL, ET AL.

It is certified that error appears in the above-identified patent and that said Letters Patent is hereby corrected as shown below:

Column 14, line 66, Please insert a comma between "0.4g" and "sodium".

Column 14, line 66, Please insert a comma after "2.2g".

Column 14, line 67, Please insert a comma after "1g".

Column 14, line 68, Please insert a comma after "0.03g".

Column 16, line 13, "aci" should read -- acid --.

Signed and Sealed this

Twenty-eighth Day of May, 1991

*Attest:*

HARRY F. MANBECK, JR.

*Attesting Officer*

*Commissioner of Patents and Trademarks*